US007823759B2

(12) United States Patent
Jiang

(10) Patent No.: US 7,823,759 B2
(45) Date of Patent: Nov. 2, 2010

(54) SPRING POWERED STAPLER

(76) Inventor: Peigen Jiang, 19480 SE. 28th Pl., Sammamish, WA (US) 98075

( * ) Notice: Subject to any disclaimer, the term of this patent is extended or adjusted under 35 U.S.C. 154(b) by 92 days.

(21) Appl. No.: 11/962,105

(22) Filed: Dec. 21, 2007

(65) Prior Publication Data

US 2009/0159638 A1 Jun. 25, 2009

(51) Int. Cl.
*B25C 5/06* (2006.01)

(52) U.S. Cl. ..... 227/132; 227/134; 227/120; 227/142

(58) Field of Classification Search ..... 227/132, 227/134, 120, 142; 264/158, 239
See application file for complete search history.

(56) References Cited

U.S. PATENT DOCUMENTS

| | | | | |
|---|---|---|---|---|
| 2,326,540 | A * | 8/1943 | Helen | 173/31 |
| 2,493,640 | A * | 1/1950 | Peterson | 227/132 |
| 5,699,949 | A * | 12/1997 | Marks | 227/132 |
| 6,789,719 | B2 * | 9/2004 | Shor | 227/132 |
| 7,097,086 | B2 * | 8/2006 | Joyce et al. | 227/120 |
| 7,097,088 | B2 * | 8/2006 | Shor | 227/132 |
| 7,243,832 | B2 * | 7/2007 | Jiang | 227/120 |
| 7,299,960 | B1 * | 11/2007 | Marks et al. | 227/132 |
| 7,387,227 | B1 * | 6/2008 | Jiang et al. | 227/8 |
| 7,395,955 | B2 * | 7/2008 | Zins et al. | 227/132 |
| 7,404,507 | B2 * | 7/2008 | Marks | 227/132 |
| 7,464,844 | B2 * | 12/2008 | Kamins et al. | 227/132 |
| 7,513,406 | B2 * | 4/2009 | Marks | 227/120 |
| 2007/0023473 | A1 * | 2/2007 | Jiang | 227/132 |
| 2007/0034664 | A1 * | 2/2007 | Jiang | 227/132 |
| 2009/0050666 | A1 * | 2/2009 | Jiang | 227/120 |
| 2009/0159632 | A1 * | 6/2009 | Jiang | 227/8 |

* cited by examiner

*Primary Examiner*—Rinaldi I. Rada
*Assistant Examiner*—Michelle Lopez

(57) ABSTRACT

This invention provides a spring powered stapler comprising a power spring having a front and a rear end, the rear end of the power spring being limited from moving frontward, a middle section between the front and rear end of the power spring being bent down while the front and rear end of the power spring maintaining in upper positions for storing energy in the power spring, and the front end of the power spring moving rearward as a result of the middle section of the power spring being bent down, and a lock plate, while not moving, holding up the front end of the power spring before the rearward movement of the front end of the power spring exceeding a predetermined distance and releasing the front end of the power spring after the rearward movement of the front end of the power spring exceeding the predetermined distance.

20 Claims, 3 Drawing Sheets

SPRING POWERED STAPLER

BACKGROUND

The present invention relates generally to staplers, and more specifically, to spring powered staplers.

A key for a staple to have good penetration is its entry speed. A spring powered stapler uses a spring to store energy. Upon a release of the stored spring energy, a staple can be driven out at a great speed therefore can have very good penetration. There are various spring powered staplers, the goal of the present invention is to make a simpler spring powered stapler.

SUMMARY

In view of the foregoing, this invention provides a spring powered stapler comprising a power spring having a front and a rear end, the rear end of the power spring being limited from moving frontward, a middle section between the front and rear end of the power spring being bent down while the front and rear end of the power spring maintaining in upper positions for storing energy in the power spring, and the front end of the power spring moving rearward as a result of the middle section of the power spring being bent down, and a lock plate, while not moving, holding up the front end of the power spring before the rearward movement of the front end of the power spring exceeding a predetermined distance and releasing the front end of the power spring after the rearward movement of the front end of the power spring exceeding the predetermined distance.

The construction and method of operation of the invention, however, together with additional objects and advantages thereof will be best understood from the following description of specific embodiments when read in connection with the accompanying drawings.

BRIEF DESCRIPTION OF THE DRAWINGS

The drawings accompanying and forming part of this specification are included to depict certain aspects of the invention. A clearer conception of the invention, and of the components and operation of systems provided with the invention, will become more readily apparent by referring to the exemplary, and therefore non-limiting, embodiments illustrated in the drawings, wherein like reference numbers (if they occur in more than one view) designate the same elements. The invention may be better understood by reference to one or more of these drawings in combination with the description presented herein. It should be noted that the features illustrated in the drawings are not necessarily drawn to scale.

DESCRIPTION

Figure 1:
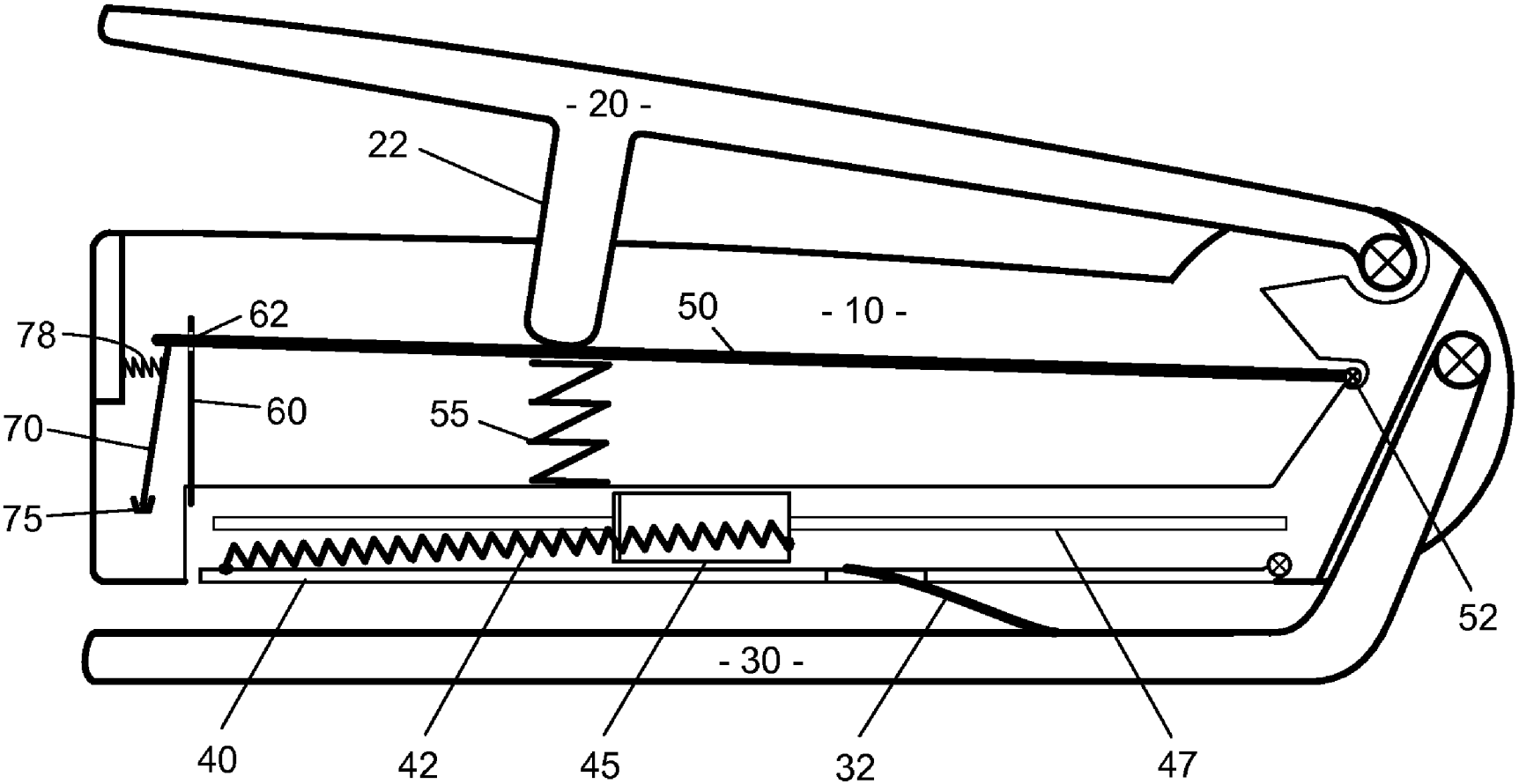
FIG. 1 is a side partial sectional view of a spring powered stapler in a resting position according to one embodiment of the present invention.

FIG. 1 is a side partial sectional view of a spring powered stapler in a resting position according to one embodiment of the present invention. The spring powered stapler comprises a housing body 10, a handle 20, a power spring 50, a return spring 55, a driving blade 60, and a lock plate 70. The power spring 50 is a plate spring. There is a push-down rod 22 affixed on the handle 20 for urging the middle section of the power spring 50 to bend downward for storing spring energy when the handle 20 is pressed down. A staple feeding track is formed at the bottom of the housing body 10, which comprises a staple retention panel 40, a sliding block 45 pulled forward by a drag spring 42 for pushing a staple magazine toward the front end of the staple feeding track. The sliding block 45 is confined by a pair of horizontal slots 47 formed on each internal side walls of the feeding track. In the resting position, the spring powered stapler sits on a base plate 30. A base spring 32 urges the base plate 30 away from the housing body 10, so that a stack of paper or other objects can be inserted under the housing body to be stapled.

Figure 2:
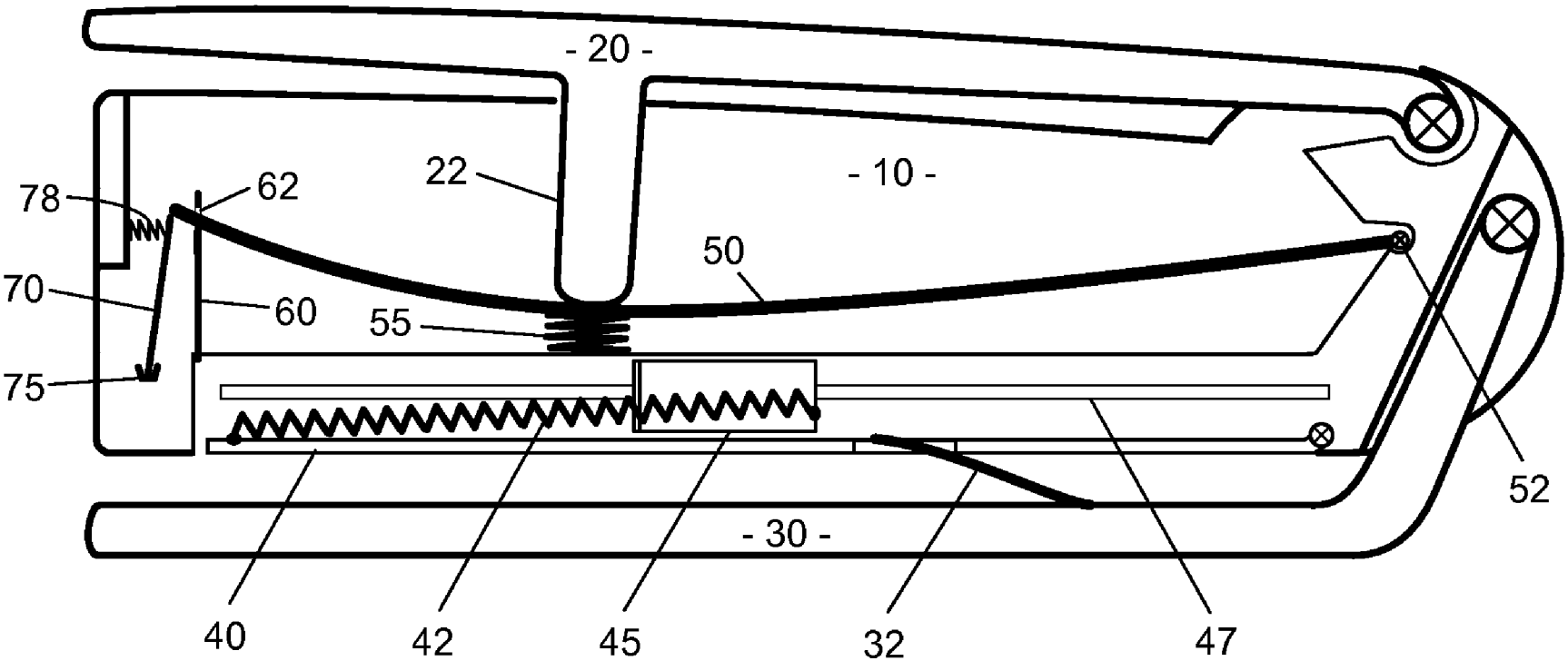
FIG. 2 is a side partial sectional view of the spring powered stapler of FIG. 1 in a position just prior to ejecting a staple.

FIG. 2 is a side partial sectional view of the spring powered stapler of FIG. 1 in a position just prior to ejecting a staple. A middle section of the power spring 50 is bent down by the handle 20 and its affiliated push-down rod 22. A front end of the power spring 50 is still held up by the lock plate 70. A rear end of the power spring 50 has a hinge-like structure 52 which allows the power spring 50 to rotate, but not to move in any direction. With the rear end of the power spring 50 being anchored, when the middle section of the power spring 50 is further bent down, the front end of the power spring will further withdraw and disengage the lock plate 70, which will result in the front end of power spring 50 to slam down as the power spring 50 releases its energy. Since the driving blade 60 is always engaged with the power spring 50, it also slams down on the staple feeding track, and expels a staple if there is any in the staple feeding track.

Referring again to FIG. 2, a bottom end of the lock plate 70 is confined by a groove 75, which is affixed to the housing body 10. A top end of the lock plate 70 can move back and forth horizontally. A push spring 78 urges the top end of lock plate 70 rearward to an extend that the lock plate 70 can hold up the front end of the power spring 50 until the handle 20 is pressed down significantly, such as to a lower limit, and cause the front end of the power spring 50 to withdraw significantly. The lock plate 70 is resting at an angle toward the rear end of the housing body 10, so that the lock plate 70 will not interfere with the power spring 50 when it is released and slams down. When the handle 20 is released, the return spring 55 pushes up the power spring 50, overcoming the urge of the push spring 78, to the resting position as shown in FIG. 1.

The above illustrations provide many different embodiments or embodiments for implementing different features of the invention. Specific embodiments of components and processes are described to help clarify the invention. These are, of course, merely embodiments and are not intended to limit the invention from that described in the claims.

Figure 3:
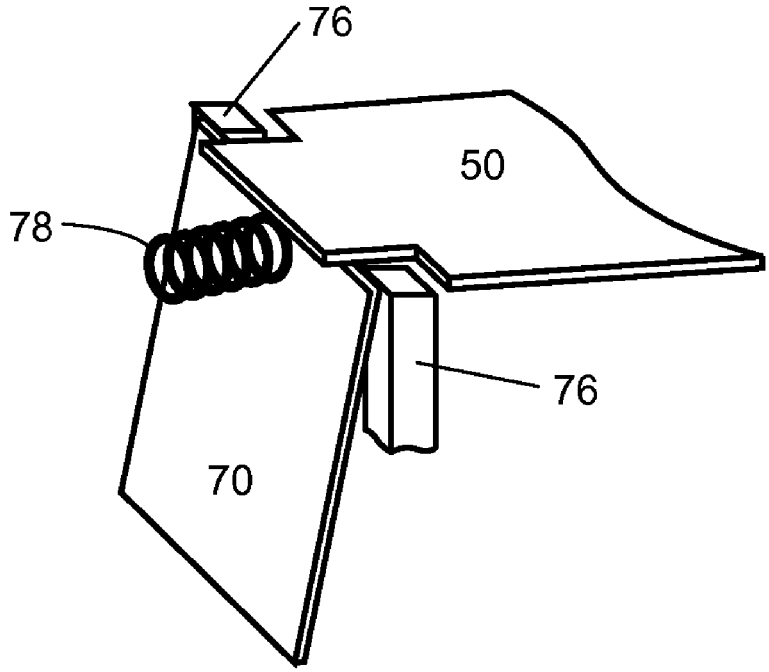
FIG. 3 is a perspective view of a locking structure of the spring powered stapler of FIG. 1.

FIG. 3 is a perspective view of the lock structure for the spring powered stapler of FIG. 1. The locking structure includes the lock plate 70, the push spring 78 and a pair of stoppers 76. The stoppers 76 are affixed on the housing body 10 and serve to stop the lock plate 70 from swing further downward, so that the lock plate 70 can hold up the power spring 50. The lock plate 70 is typically made of steel material.

Figure 4:
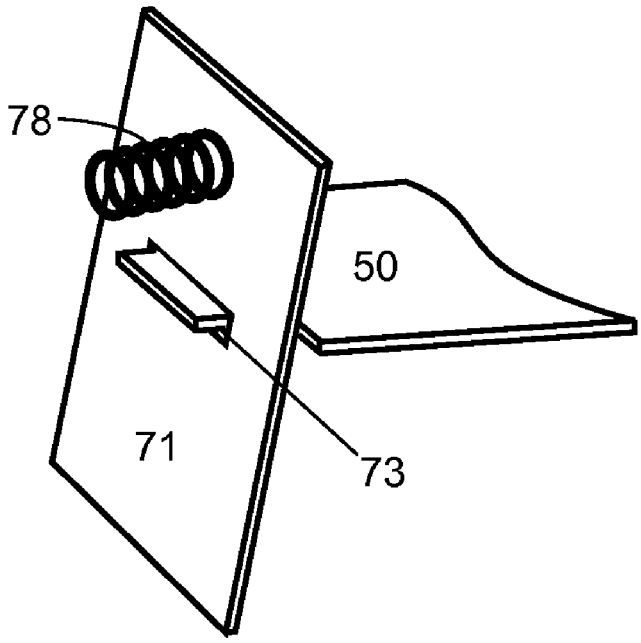
FIG. 4 is a perspective view of an alternative locking structure for the spring powered stapler of FIG. 1.

FIG. 4 is a perspective view of an alternative locking structure for the spring powered stapler of FIG. 1. The alternative locking structure differs from the locking structure shown in FIG. 3 in that a lock plate 71 of FIG. 4 takes the place of the lock plate 70 of FIG. 3. The lock plate 71 has an opening 73 to accommodate the front end of the power spring 50 for locking the same. The rest of the alternative locking structure of FIG. 4 is the same as the locking structure of FIG. 3, including using the stoppers 76 (not shown in FIG. 4) to stop the lock plate 71 from swing further downward.

Although the invention is illustrated and described herein as embodied in one or more specific examples, it is nevertheless not intended to be limited to the details shown, since various modifications and structural changes may be made therein without departing from the spirit of the invention and within the scope and range of equivalents of the claims. Accordingly, it is appropriate that the appended claims be construed broadly and in a manner consistent with the scope of the invention, as set forth in the following claims.

What is claimed is:

1. A spring powered stapler comprising:

a power spring for storing energy to force a driving blade to expel a staple, the power spring having a front and a rear end, the rear end of the power spring being limited from moving frontward;

a push-down member directly pressing down a middle section between the front and rear end of the power spring during a stapling process while the front and rear end of the power spring maintaining in upper positions for storing energy in the power spring, and the front end of the power spring moving rearward as a result of the middle section of the power spring being pressed down; and a lock plate holding up the front end of the power spring for storing energy, the lock plate, without frontward movement, disengaging the front end of the power spring when the rearward movement of the front end of the power spring exceeding a predetermined distance.

2. The spring powered stapler of claim 1, wherein the power spring is a plate spring.

3. The spring powered stapler of claim 1, wherein a top edge of the lock plate hold up the front end of the power spring for storing energy therein.

4. The spring powered stapler of claim 1, wherein the lock plate has at least one opening for holding up the front end of the power spring for storing energy therein.

5. The spring powered stapler of claim 1 further comprising a return spring linked to the power spring for returning the same to an upper position when a force for bending the power spring is removed.

6. The spring powered stapler of claim 5, wherein the return spring is located beneath the power spring.

7. The spring powered stapler of claim 1 further comprising a handle linked to the push-down member for bending the power spring for storing energy therein.

8. The spring powered stapler of claim 1 further comprising:

a push spring linked to the lock plate for pushing a top portion of the lock plate rearward; and a stopper limiting the rearward movement of the lock plate.

9. A spring powered stapler comprising:

a power spring for storing energy to force a driving blade to expel a staple, the power spring having a front and a rear end, the rear end of the power spring being limited from moving frontward;

a push-down member directly pressing down a middle section between the front and rear end of the power spring during a stapling process while the front and rear end of the power spring maintaining in upper positions for storing energy in the power spring, and the front end of the power spring moving rearward as a result of the middle section of the power spring being pressed down;

a lock plate holding up the front end of the power spring for storing energy, the lock plate, without frontward movement, disengaging the front end of the power spring when the rearward movement of the front end of the power spring exceeding a predetermined distance; and a return spring linked to the power spring for returning the same to an upper position when a force for bending the power spring is removed.

10. The spring powered stapler of claim 9, wherein the power spring is a plate spring.

11. The spring powered stapler of claim 9, wherein a top edge of the lock plate hold up the front end of the power spring for storing energy therein.

12. The spring powered stapler of claim 9, wherein the lock plate has at least one opening for holding up the front end of the power spring for storing energy therein.

13. The spring powered stapler of claim 9, wherein the return spring is located beneath the power spring.

14. The spring powered stapler of claim 9 further comprising a handle linked to the push-down member for bending the power spring for storing energy therein.

15. The spring powered stapler of claim 9 further comprising:

a push spring linked to the lock plate for pushing a top portion of the lock plate rearward; and a stopper limiting the rearward movement of the lock plate.

16. A spring powered stapler comprising:

a power spring for storing energy to force a driving blade to expel a staple, the power spring having a front and a rear end, the rear end of the power spring being limited from moving frontward;

a push-down member directly pressing down a middle section between the front and rear end of the power spring during a stapling process while the front and rear end of the power spring maintaining in upper positions for storing energy in the power spring, and the front end of the power spring moving rearward as a result of the middle section of the power spring being pressed down;

a lock plate holding up the front end of the power spring for storing energy, the lock plate, without frontward movement, disengaging the front end of the power spring when the rearward movement of the front end of the power spring exceeding a predetermined distance;

a push spring linked to the lock plate for pushing a top portion of the lock plate rearward; and a stopper limiting the rearward movement of the lock plate.

17. The spring powered stapler of claim 16, wherein a top edge of the lock plate hold up the front end of the power spring for storing energy therein.

18. The spring powered stapler of claim 16, wherein the lock plate has at least one opening for holding up the front end of the power spring for storing energy therein.

19. The spring powered stapler of claim 9 further comprising a return spring linked to the power spring for returning the same to an upper position when a force for bending the power spring is removed.

20. The spring powered stapler of claim 9 further comprising a handle linked to the push-down member for bending the power spring for storing energy therein.

* * * * *